US012510318B1

(12) United States Patent
Bray

(10) Patent No.: US 12,510,318 B1
(45) Date of Patent: Dec. 30, 2025

(54) FIREARM TRIGGER

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 19/308,133

(22) Filed: Aug. 22, 2025

Related U.S. Application Data

(63) Continuation-in-part of application No. PCT/US2024/060392, filed on Dec. 16, 2024.

(51) Int. Cl.
*F41A 19/31* (2006.01)

(52) U.S. Cl.
CPC ..... *F41A 19/31* (2013.01)

(58) Field of Classification Search
CPC ..... F41A 19/31
USPC ..... 42/69.02
See application file for complete search history.

(56) References Cited

U.S. PATENT DOCUMENTS 5,669,169 A * 9/1997 Schmitter ..... F41A 3/66 89/196
10,184,742 B2 1/2019 Gray
10,684,087 B2 6/2020 Thomele et al.
11,466,951 B2 10/2022 Vaughan et al.
11,959,712 B1 4/2024 Canny
12,152,849 B1 * 11/2024 Bray ..... F41A 19/12
2006/0156607 A1 * 7/2006 Curry ..... F41A 19/15 42/69.01
2006/0248772 A1 * 11/2006 Curry ..... F41A 19/12 42/69.02
2012/0167426 A1 * 7/2012 O'Clair ..... F41A 11/02 42/2
2016/0040949 A1 * 2/2016 Lee ..... F41A 19/32 42/69.01
2019/0041151 A1 * 2/2019 Folk ..... F41A 19/10
2022/0397359 A1 * 12/2022 Velasquez ..... F41A 19/31
2024/0011729 A1 * 1/2024 Dechant ..... F41A 19/31
2024/0310133 A1 9/2024 Rainaud et al.
2024/0410666 A1 * 12/2024 Lee ..... F41A 19/30
2025/0060182 A1 * 2/2025 Horner ..... F41A 19/31

* cited by examiner

*Primary Examiner* — Samir Abdosh
(74) *Attorney, Agent, or Firm* — Kunzler Bean & Adamson

(57) ABSTRACT

Disclosed is a linear trigger mechanism for a firearm. In certain examples, the trigger mechanism includes a trigger housing configured to couple with a fire control unit of the firearm, and a trigger slideably coupled with the trigger housing and movable along a linear path. The linear trigger mechanism also includes a trigger bar having a first end coupled with the trigger and a second end coupled with a sear activation module, where the sear activation module is moveable with respect to the fire control unit along a longitudinal path with the trigger bar, and where the sear activation module is moveable laterally with respect to the trigger bar.

20 Claims, 12 Drawing Sheets

FIREARM TRIGGER

CROSS-REFERENCES TO RELATED APPLICATIONS

This is a continuation-in-part application of and claims priority to, United States PCT Patent Application Number PCT/US2024/060392 entitled "FIREARM TRIGGER" and filed on Apr. 16, 2024 for Ernest R. Bray, which is incorporated herein by reference.

FIELD

This disclosure relates generally to firearms, and more particularly to linear trigger mechanisms for firearms.

BACKGROUND

Firearms typically have a trigger mechanism that is used to discharge the firearm. Commonly, trigger mechanisms have a spring-loaded hammer that strikes a firing pin that in turn strikes an ammunition cartridge positioned in a chamber of the firearm. Pulling a trigger of the trigger mechanism initiates this sequence. A rough or uneven trigger pull can affect the accuracy of the firearm.

SUMMARY

Disclosed is a linear trigger mechanism for a firearm. In certain examples, the trigger mechanism includes a trigger housing configured to couple with a frame of the firearm. The trigger mechanism also includes a trigger disposed below the trigger housing and slideably coupled with the trigger housing, and a trigger bar having a first end coupled with the trigger and a second end slideably coupled with an ejector housing. The trigger mechanism also includes a sear assembly pivotally coupled with the second end of the trigger bar and configured to engage a firing pin of the firearm.

The trigger mechanism also includes, in certain examples, a trigger safety slideably coupled with the trigger and moveable between a first position and a second position with reference to the trigger. The trigger mechanism may also include a blocking lever pivotally coupled with the trigger and moveable between a blocking position that prevents linear movement of the trigger and an allow position that allows linear movement of the trigger.

In certain examples, the trigger safety is configured to actuate the blocking lever and move the blocking lever from the blocking position to the allow position when the trigger safety is moved to the second position. The trigger mechanism also includes a compression spring configured to bias the blocking lever to blocking position.

The trigger mechanism also includes, in certain examples, a spring-loaded ball detent disposed between the sear assembly and the ejector housing, where the spring-loaded ball detent is configured to bias the sear assembly to a locking position that prevents the firing pin from moving with reference to the frame. In certain examples, the trigger mechanism also includes a connector having a first end that is coupled with the ejector housing and a second end that is configured to actuate the sear assembly in response to the trigger moving rearward with reference to the frame. The trigger housing may include a slotted channel configured to define a path of travel of the trigger. In certain examples, the trigger is formed with a slotted tab configured to engage the slotted channel. The path of travel is linear and substantially parallel with a bore axis of the firearm.

Also disclosed is a firearm that implements the trigger mechanism. The firearm includes a frame, a slide, a barrel, the trigger mechanism, and other components. Also disclosed is a method for providing the firearm. In certain examples, the method includes providing a trigger housing configured to couple with a frame of the firearm, and providing a trigger disposed below the trigger housing and slideably coupled with the trigger housing. In certain examples, the method includes providing a trigger bar having a first end coupled with the trigger and a second end slideably coupled with an ejector housing, and providing a sear assembly pivotally coupled with the second end of the trigger bar and configured to engage a firing pin of the firearm.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
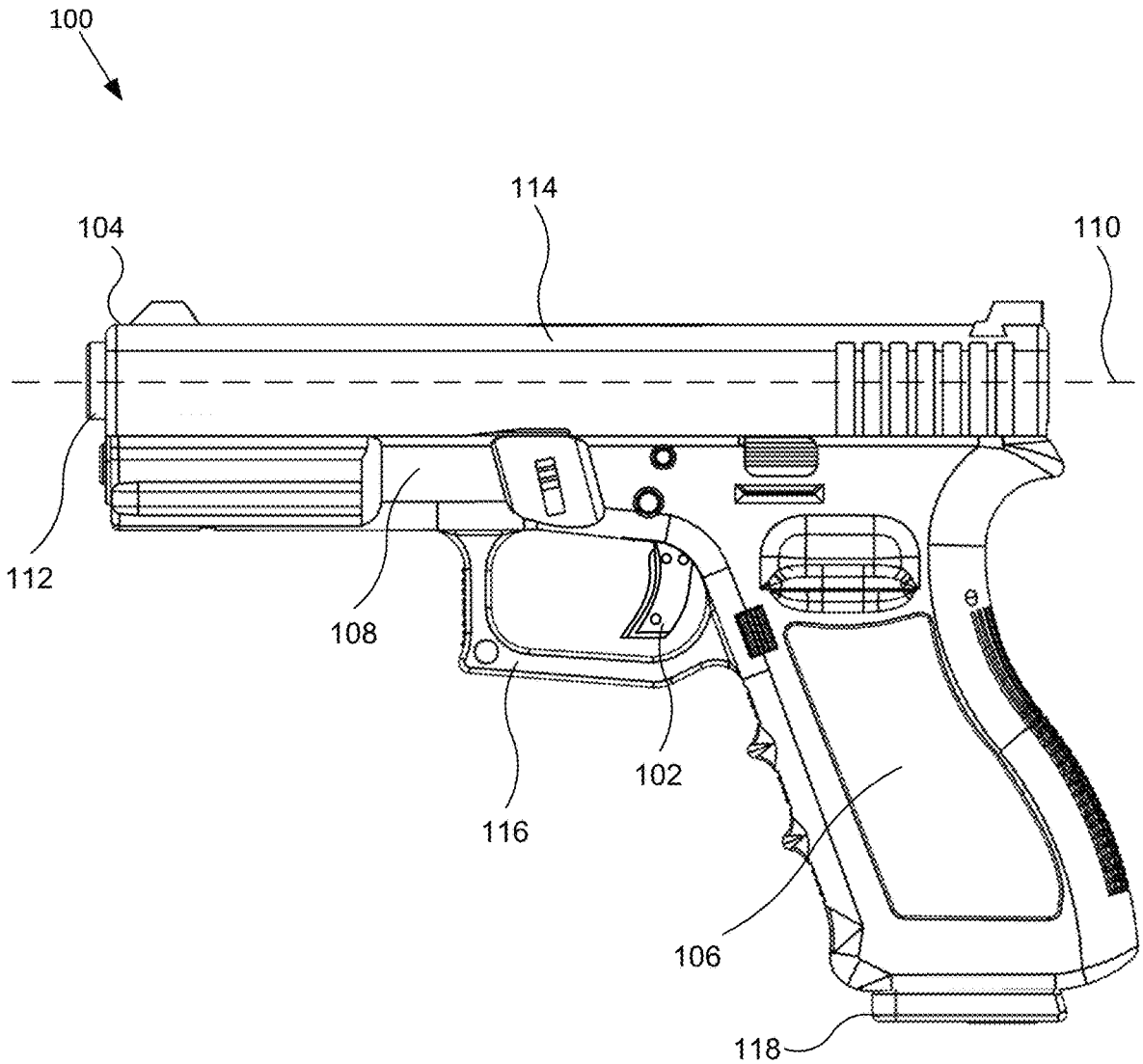
FIG. 1 is a side view diagram illustrating one example of a firearm including an improved trigger mechanism in accordance with examples of the subject disclosure.

FIG. 1 is a side view diagram illustrating one example of a firearm 100 including an improved trigger mechanism 102 in accordance with examples of the subject disclosure. The trigger mechanism 102, in the depicted example, may be used with the GLOCK® family of firearms or clones. As used herein, the terms "forward" and "front" refer to ends of mechanisms that are nearest the muzzle end 104 of the firearm 100. Similarly, "rear," or "rearward," corresponds to ends of mechanisms that are furthest from the muzzle end 104 of the firearm (i.e., towards grip 106). Terms such as "top" and "bottom" may also be used and refer to component positions as if the firearm were held in a traditional orientation, for example with the slide 114 located on "top" of or "above" the frame 108. However, it is contemplated that the features of the current disclosure are equally applicable to other types of firearms.

As will be discussed in greater detail below, the present disclosure provides a linearly moving trigger slide mounted within the trigger mechanism 102 to provide predictability and repeatability of trigger pulls. The trigger slide beneficially moves linearly in relation to a frame 108 of the firearm 100. In certain examples, the trigger slide moves substantially parallel with a bore axis 110 that is defined by a barrel 112 of the firearm 100.

The firearm 100 generally comprises a slide 114 that houses and carries the barrel 112. The slide 114 moves forward and backward on the frame 108 when the firearm 100 is fired. The frame 108 is formed with the grip 106 portion, and a trigger guard 116. The grip 106 is hollow and forms a magazine well for a magazine 118.

Figure 2:
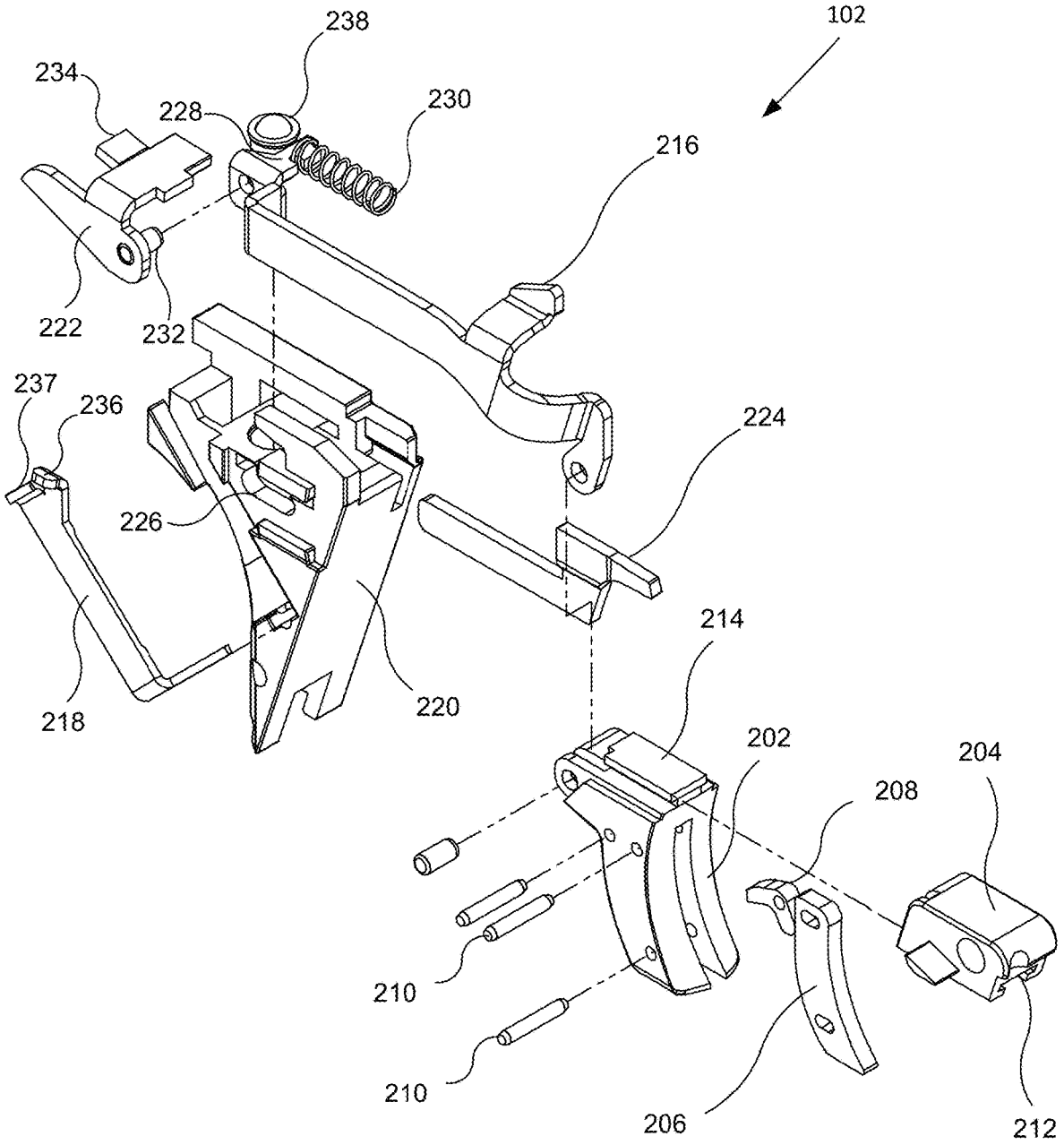
FIG. 2 is an exploded view diagram illustrating one example of the trigger mechanism, in accordance with examples of the subject disclosure.

FIG. 2 is an exploded view diagram illustrating one example of the trigger mechanism 102, in accordance with examples of the subject disclosure. The trigger mechanism 102, beneficially, provides a trigger 202 that slides linearly with respect to the frame 108. Conversely, all current GLOCK® triggers rotate about a pivot point.

In certain examples, the trigger mechanism 102 includes the trigger 202, a trigger housing 204, a trigger safety 206, and a blocking lever 208. The trigger 202 has a generally concave surface configured for engaging a finger of an operator. A vertically oriented opening in the concave surface is configured to receive the trigger safety 206. The trigger safety 206, as depicted, is an elongated member having a concave finger-engaging surface that is similar to the concave surface of the trigger 202. The trigger safety 206 is configured to slide forward and backward with reference to the trigger 202. Elongated, horizontally oriented slots are formed in the trigger safety 206 and are configured to receive a pin 210. The elongated slot has a width greater than a diameter of the pin 210 and defines a path through which the trigger safety 206 moves. In other words, the trigger safety 206 moves from a default position where the trigger 202 is not allowed to release a firing pin, to an activated position that engages the blocking lever 208 and allows the trigger 202 to release the firing pin. The blocking lever 208 will be described in greater detail below with respect to FIGS. 4A-4C.

The trigger housing 204, in certain examples, is positioned forward of the trigger 202 in the frame 108, and includes a trigger housing slot 212 for defining a linear pathway for the trigger 202. In some examples, the trigger housing slot 212 is an inverted T-slot track that is configured to receive a T-shaped tab 214 of the trigger 202. In certain examples, the tab 214 is disposed on top of the trigger 202. Although T-shaped slots and tabs are depicted, any shape track and tab system is contemplated. Beneficially, the trigger housing 204 and the trigger housing slot 212 define a pathway that linear and substantially parallel with the axis 110. A linearly moving trigger 202, instead of a trigger that pivots around a pivot point, produces a better trigger pull that is repeatable because a compression spring may be used to bias the movement of the trigger 202.

In certain examples, the trigger mechanism 102 also includes a trigger bar 216, a connector 218, an ejector housing 220, a sear assembly 222, and an ejector 224. The trigger bar 216 slideably couples the trigger 202 with the ejector housing 220. A slot 226 formed in a side of the ejector housing 220 defines a pathway for a laterally extending protrusion 228 of the trigger bar 216. Disposed within the ejector housing 220 is a torsion spring 230 that biases the trigger bar 216, and consequently the trigger 202, toward a first position. In other words, the torsion spring 230 urges the trigger 202 to a first position that does not allow the firearm 100 to fire. When an operator squeezes the trigger 202, if the force applied to the trigger 202, which is transferred through the trigger bar 216, is sufficient to overcome the torsion spring 230, then the firing pin is released, as will be described in greater detail below.

The sear assembly 222, in certain examples, includes a pin 232 that extends through an opening in an end of the trigger bar 216 and into the slot 226 in the ejector housing 220. The sear assembly 222 includes an upwardly extending catch 234 that engages the firing pin each time the slide 114 recoils after firing a round. An outwardly extending tab 237 of the connector 218 engages a protrusion of the sear assembly 222. As the trigger 202 moves linearly rearward, the trigger bar 216 and the sear assembly 222 likewise move and push downward on the connector 218. The tab 237 pulls the sear assembly 222 downward and causes it to pivot about the pin 232. If the rotational movement is sufficient, the catch 234 releases the firing pin and the firearm 100 fires. In certain examples, a spring-loaded ball detent 238 biases the sear assembly 222 into a position that maintains the firing pin a "ready to fire" position. The finger 236 engages a portion of the underside of the slide, which allows the sear assembly 222 to be released and moved upward, after firing by the spring-loaded ball detent 238, into a position to engage the firing pin. The spring-loaded ball detent 238 is disposed partially, in certain examples, within the ejector housing 220. The spring-loaded ball detent 238 is disposed between the ejector housing 220 and the sear assembly 222.

Figure 3:
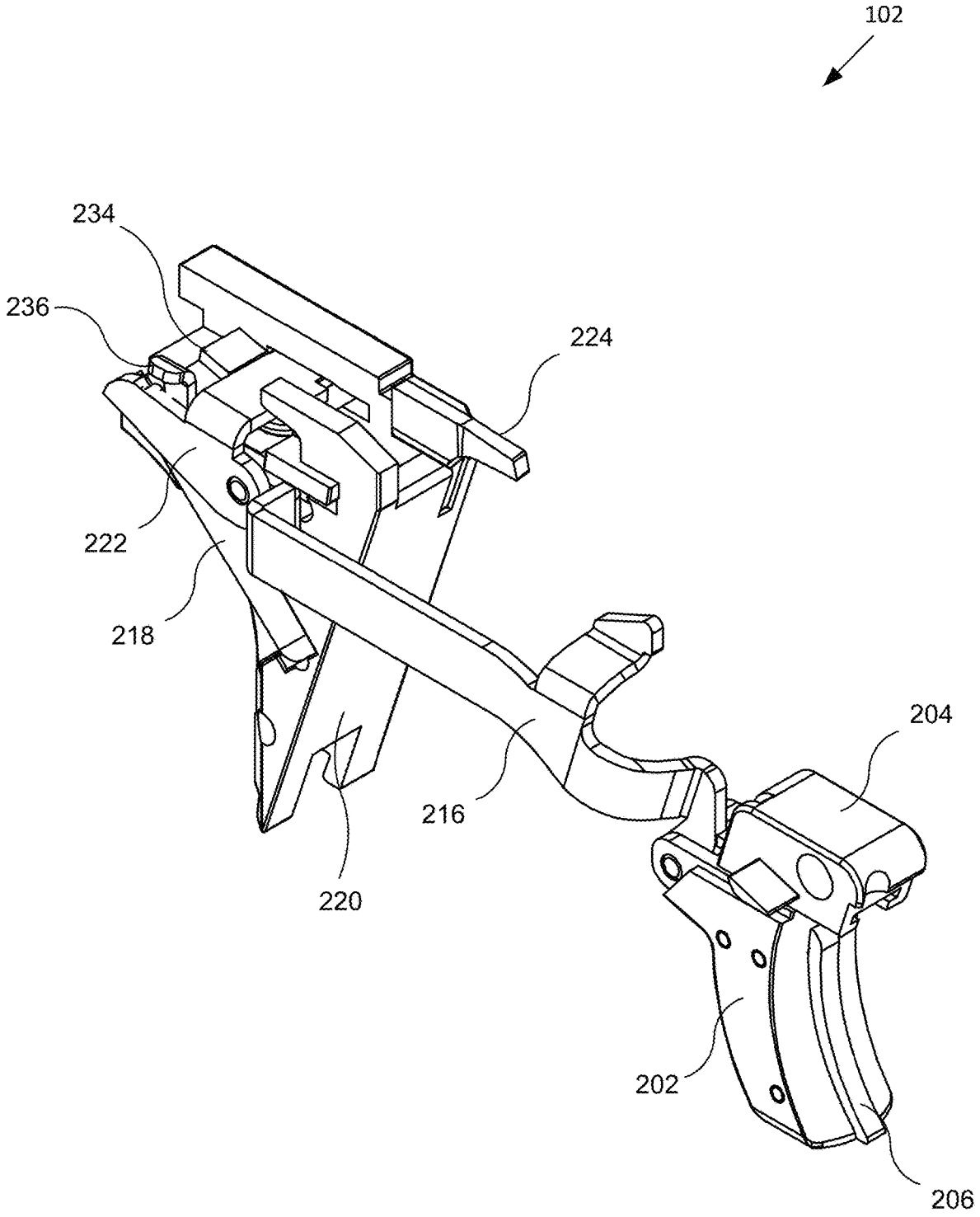
FIG. 3 is a perspective view diagram of the trigger mechanism, in accordance with examples of the subject disclosure.

FIG. 3 is a perspective view diagram of the trigger mechanism 102, in accordance with examples of the subject disclosure. The depicted example illustrates the trigger mechanism 102 in an assembled state. As described above, the trigger 202 moves linearly along a longitudinal axis (i.e., from front to rear of the firearm 100, or vice versa) when actuated by an operator. Linear movement of the trigger 202 is transferred by the trigger bar 216 to the sear assembly 222 and the connector 218. As the connector 218 pivots downward, the finger 236 pulls the sear assembly 222 downward and the catch 234 disengages from the firing pin.

Figure 4A:
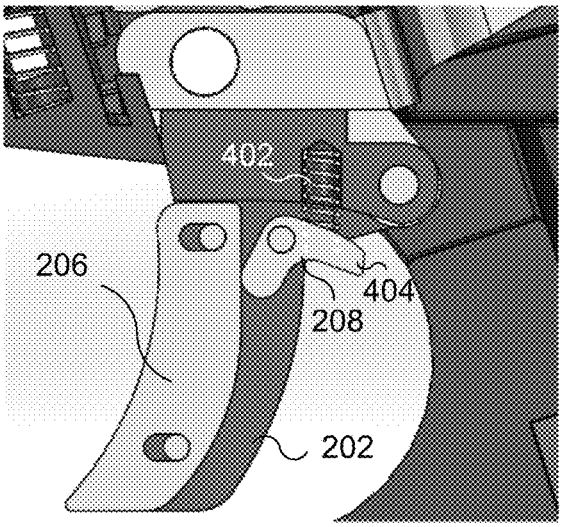
FIG. 4A is a side view diagram illustrating the trigger and the blocking lever, in accordance with examples of the subject disclosure.
Figure 4B:
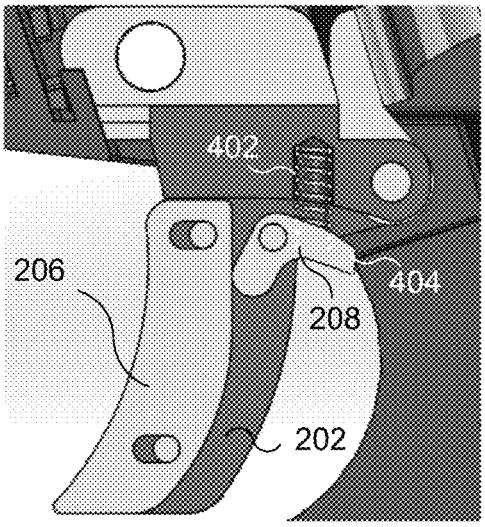
FIG. 4B is another side view diagram illustrating the trigger and the blocking lever, in accordance with examples of the subject disclosure.
Figure 4C:
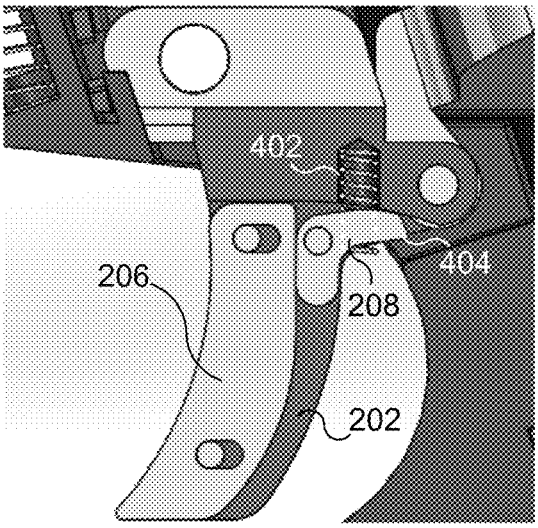
FIG. 4C is another side view diagram illustrating the trigger and the blocking lever, in accordance with examples of the subject disclosure.

FIGS. 4A, 4B, and 4C are side view diagrams illustrating the trigger 202 and the blocking lever 208, in accordance with examples of the subject disclosure. FIG. 4A depicts the trigger 202, the trigger safety 206, and the blocking lever 208 in a first position that is not actuated or pulled by an operator. In the first position, the trigger safety 206 is biased forward by a spring 402 that pushes downward on one leg of the blocking lever 208. The leg is rotated and positioned by the spring 402 in a slightly downward orientation that prevents the trigger 202 from moving linearly towards the rear of the firearm 100.

FIG. 4B depicts a situation where the trigger safety 206 is not depressed relative to the trigger 202. In certain examples, when the trigger safety 206 is not depressed and the trigger 202 is moved, the leg 404 contacts the frame 108 and prevents further rearward movement of the trigger 202.

FIG. 4C depicts a situation where the trigger safety 206 is depressed and moved rearwardly before the trigger 202 is moved. In certain examples, the trigger safety 206 pushes on the blocking lever 208 and rotates the leg 404 upward, which compresses the spring 402, and allows the trigger 202 to move rearward to a position that disengages the catch 234 and allows the firearm 100 to fire.

Figure 5B:
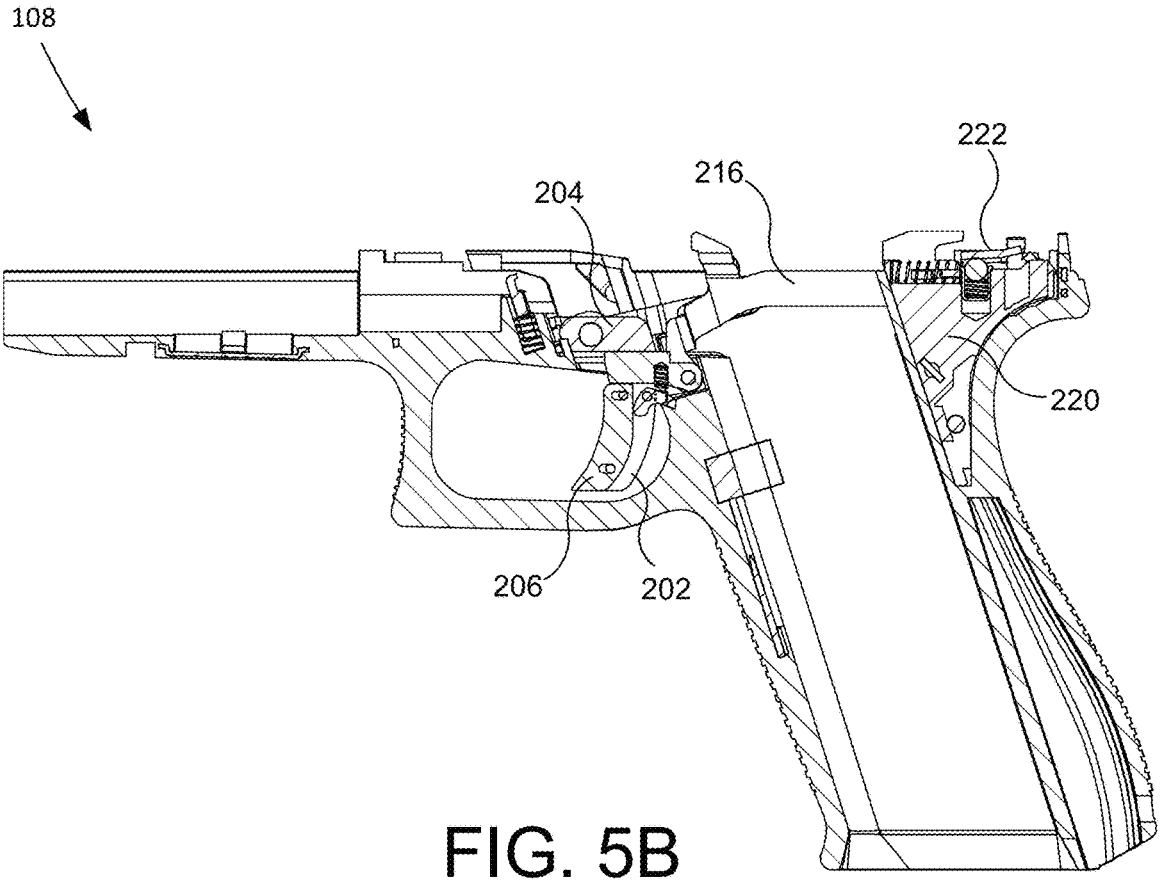
FIG. 5B is a cross-sectional diagram of the frame, in accordance with examples of the subject disclosure.
Figure 5A:
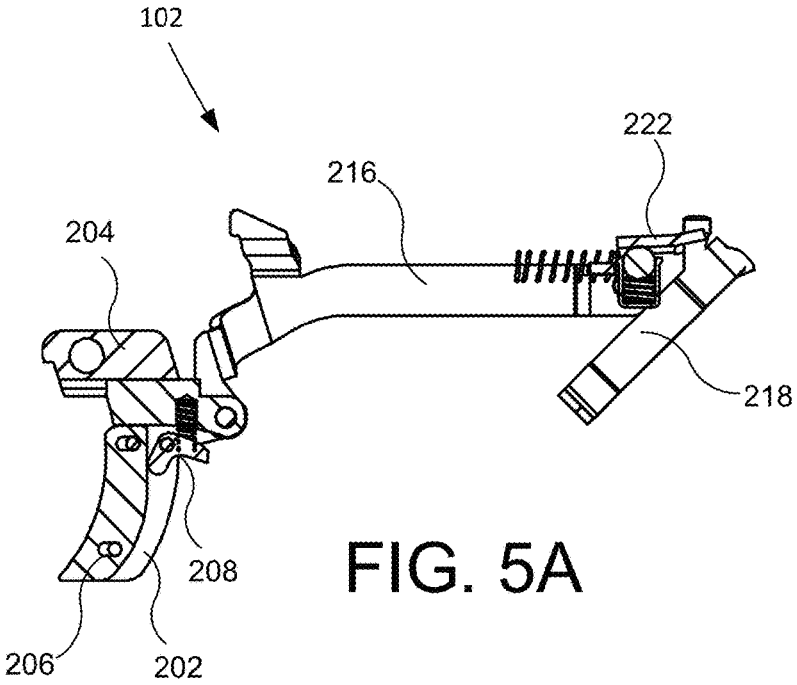
FIG. 5A is cross-sectional diagram of the trigger mechanism, in accordance with examples of the subject disclosure.

FIGS. 5A and 5B are cross-sectional diagrams of the trigger mechanism 102 and the frame 108, respectively, in accordance with examples of the subject disclosure. Depicted here is the left side of the frame 108 with the trigger mechanism 102 installed. As described above, the trigger safety 206 is disposed in a slot of the trigger 202. The trigger safety 206 is movable from a first position to a second position with reference to the trigger 202. The trigger 202 is movable from a first position to a second position with reference to the frame 108. If the trigger 202 moves before the trigger safety 206 is moved to the second position, the blocking lever 208 prevents the trigger 202 from moving sufficiently to fire the firearm 100. In certain examples, the trigger 202 is coupled to an end of the trigger bar 216. Also depicted here is the connector 218, the ejector housing 220, the sear assembly 222, the ball detent 238.

Figure 6:
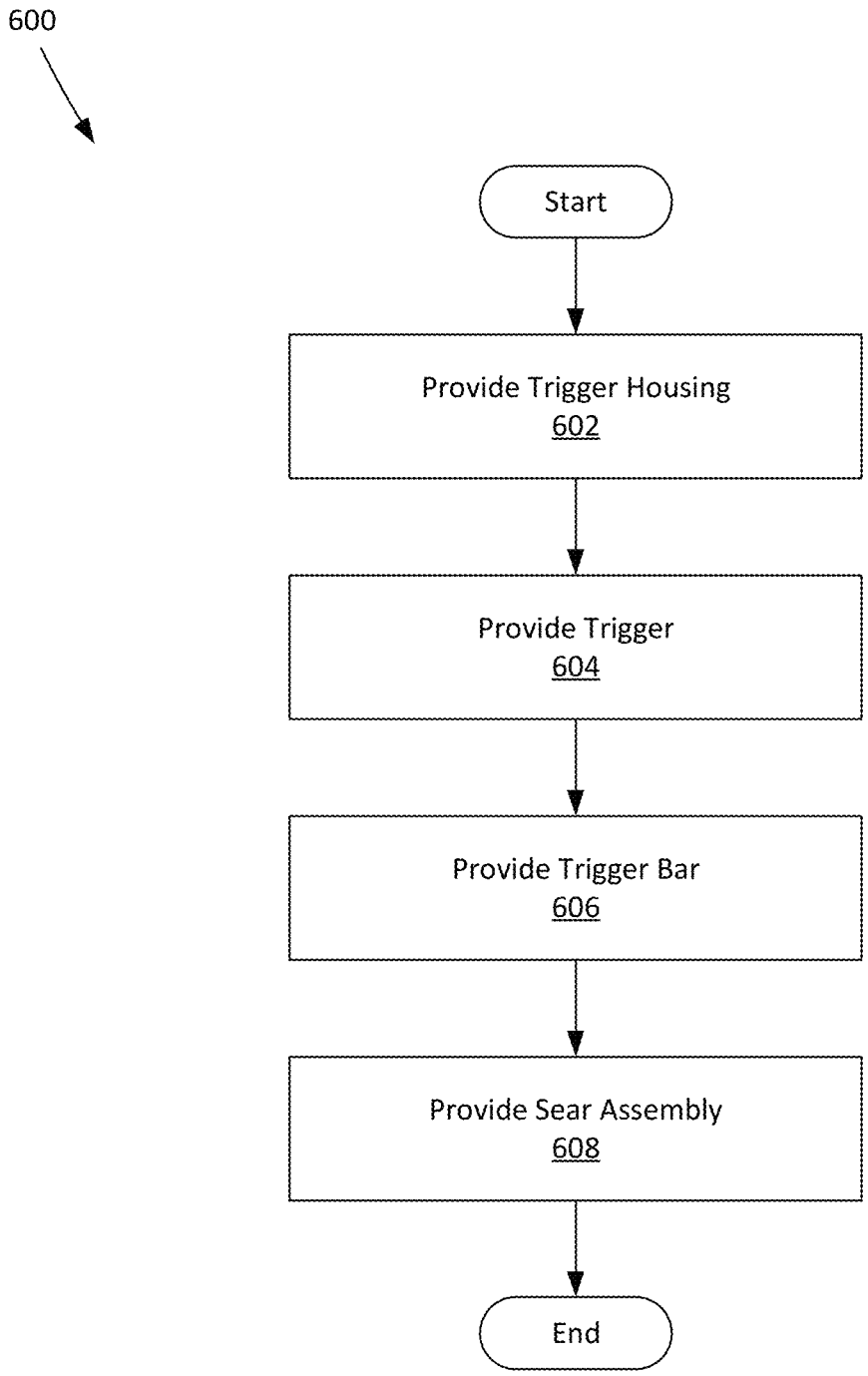
FIG. 6 is a schematic flowchart diagram illustrating one example of a method for providing a trigger mechanism in accordance with examples of the subject disclosure.

FIG. 6 is a schematic flowchart diagram illustrating one example of a method 600 for providing a trigger mechanism 102 in accordance with examples of the subject disclosure. In certain examples, the method 600 starts and, at block 602, a trigger housing is provided that is configured to couple with a frame of the firearm. The trigger housing is provided as described above with reference to FIGS. 1-5. The method 600 continues at block 604, and a trigger is provided. In certain examples, the trigger is slideable linearly with respect to the frame.

At block 606, the method 600 continues and a trigger bar is provided. The trigger bar, in certain examples, is provided as described above, with a first end coupled with the trigger, and a second end coupled with the ejector housing. At block 608, the method 600 continues and a sear assembly is provided. The sear assembly, in certain examples, is pivotally coupled with the second end of the trigger bar, as described above.

Figure 7:
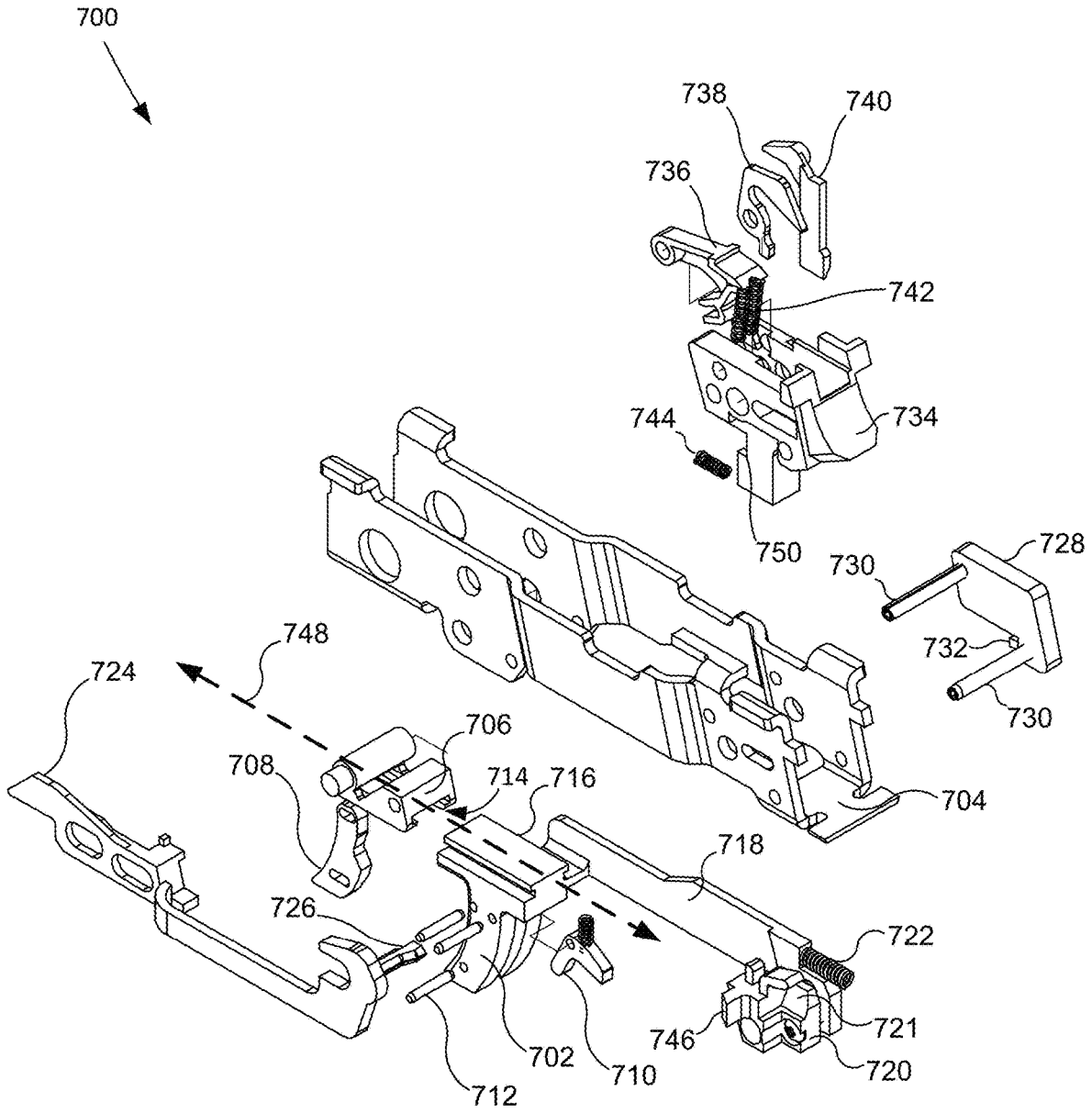
FIG. 7 is an exploded view diagram illustrating another example of a linearly moving trigger mechanism for a firearm, in accordance with examples of the subject disclosure.

FIG. 7 is an exploded view diagram illustrating another example of a linearly moving trigger mechanism for a firearm, in accordance with examples of the subject disclosure. A trigger mechanism 700, beneficially, includes a trigger 702 that slides linearly with respect to a frame of a firearm having a modular fire control unit 704. An example of a firearm utilizing a modular fire control unit 704, in accordance with examples of the subject disclosure, includes but is not limited to the P320 pistol manufactured by SIG SAUER®. Similarly to the firearm described above with reference to FIGS. 1-6, current trigger mechanisms for SIG SAUER® pistols pivot about a pivot point. Conversely, the examples of FIGS. 7-12 describe a linearly moving trigger with an integrated safety mechanism.

In certain examples, the trigger mechanism 700 includes the trigger 702, a trigger housing 706, a trigger safety 708, and a blocking lever 710. The trigger 702 has a generally concave surface configured for engaging a finger of an operator. A vertically oriented opening or slot in the concave surface is configured to receive the trigger safety 708. The trigger safety 708, as depicted, is an elongated member having a concave finger-engaging surface that is similar to the concave surface of the trigger 702. In some examples the trigger is flat. The trigger safety 206 is configured to slide linearly forward and backward with reference to the trigger 702. Elongated, horizontally oriented slots are formed in the trigger safety 708 and are configured to receive a pin 712. The elongated slot has a width greater than a diameter of the pin 712 and defines a path through which the trigger safety 708 moves. In other words, the trigger safety 708 moves from a default position where the trigger 702 is not allowed to release a firing pin or striker assembly, to an activated position that engages the blocking lever 710 and allows the trigger 702 to release the firing pin. The blocking lever 710 functions similarly to the blocking lever 208 described above with reference to FIGS. 4A-4C.

The trigger housing 706, in certain examples, is positioned forward of the trigger 702 in the fire control unit 704, and includes a trigger housing slot 714 for defining a linear pathway for the trigger 702. The trigger housing 706 rigidly couples with the fire control unit 704. The fire control unit 704 is provided with multiple openings for facilitating the coupling of the trigger housing 706 and other components.

In some examples, the trigger housing slot 714 is an inverted (or upside-down) T-slot track that is configured to receive a T-shaped tab 716 of the trigger 702. In certain examples, the tab 716 is disposed on top of the trigger 702. Although T-shaped slots and tabs are depicted, any shape track and tab system is contemplated. Beneficially, the trigger housing 706 and the trigger housing slot 714 define a pathway that is linear and substantially parallel with a bore axis of a barrel. A linearly moving trigger 702, instead of a trigger that pivots around a pivot point, produces a better trigger pull that is repeatable because a compression spring may be used to bias the movement of the trigger 702.

In certain examples, the trigger mechanism 700 also includes a trigger bar 718, a sear activation module 720, and a trigger bar return spring 722. The trigger bar 718 extends longitudinally (i.e., from forward to backward) from the trigger 702 to the sear activation module 720. The trigger bar 718 couples to a side of the trigger 702 and moves linearly with the trigger 702 when a user applies a force to the trigger 702. The trigger 702 and the trigger bar 718 may be formed as a single unit, or alternatively as separate components that are joined together with a fastener. The sear activation module 720, in certain examples, includes a ramp surface 721 that corresponds with a ramp surface of a disconnector 740. Downward movement of the disconnector 740 causes lateral movement of the sear activation module 720 with respect to the fire control unit 704. The trigger bar return spring 722 biases the trigger 702 towards a forward position. Beneficially, a user can adjust the force required to actuate the trigger 702 by replacing the trigger bar return spring 722 with a compression spring having a greater or lesser spring rate.

The fire control unit 704 is installed in an open region of a firearm frame (not shown) and is secured to the frame with a pin that extends laterally through the frame. The components depicted in FIG. 7 couple to the fire control unit 704 and are moveable with the fire control unit 704 between different firearm frames. In this sense, the fire control unit 704 is modular.

A takedown bar 724, in certain examples, extends longitudinally along the outside of the fire control unit 704 from a takedown lever (not shown) to a seer catch 726 that extends laterally from the takedown bar 724 to engage the sear activation module 720. The takedown bar 724, as is known to those skilled in the art, is moveable from a first position (e.g., a firing position) to a second position (e.g., a takedown or disassembly position). Moving the takedown bar 724 to the second position in a direction that is generally parallel to the bore axis causes the sear to disengage from a striker and allows disassembly of the firearm.

In certain examples, a trigger bar spring retainer block 728 is coupled with the fire control unit 704. The trigger bar spring retain block 728 captures and maintains the trigger bar return spring 722. In certain examples, the trigger bar spring retainer block 728 is disposed on an outside vertical surface of the fire control unit 704. Pins 730 extend laterally from the trigger bar spring retainer block 728 through the fire control unit 704. A tab 732 formed on the trigger bar spring retainer block 728 is configured to engage an end of the trigger bar return spring 722. As discussed above, the trigger bar return spring 722 urges the trigger bar 718, and subsequently the trigger 702 forward. With respect to the fire control unit 704, the trigger bar 718 and the trigger 702 are moveable longitudinally (e.g., along a direction generally parallel with a bore axis of the barrel) while the trigger bar spring retainer block 728 is not moveable.

The trigger mechanism 700 for firearms utilizing modular fire control units 704 also includes, in certain examples, a sear housing 734, a sear module 736, a striker block safety deactivation lever 738, a disconnector 740, and one or more sear springs 742. Also depicted is a takedown lever spring 744. The sear housing 734 houses the sear module 736, the striker block safety deactivation lever 738, and the disconnector 740. Each of these components are movable with respect to the sear housing 734. The sear housing 734 is in turn coupled with the fire control unit 704.

The striker block safety deactivation lever 738, in certain examples, is actuated by the rearward movement of the trigger bar 718 and the attached sear activation module 720. As these components move rearward, the striker block safety deactivation lever 738 rotates upward in a "rear-to-front" rotation that depresses a striker block lever in the slide (not shown) that allows the striker to move forward. This "rear-to-front" rotation is the opposite of current pistols that use modular fire control units 704 that employ a "front-to-rear" rotation. This is because in current generation pistols, actuation of the trigger causes a trigger bar to move forward towards the muzzle of the pistol. Conversely, when a user actuates the trigger 702 of the disclosed examples contained herein, the trigger 702 and the coupled trigger bar 718 move rearward. Subsequently, the striker block safety deactivation lever 738 is rotated forward.

Beneficially, the depicted components force the full engagement of a sear engagement surface of the sear module 736 with a striker mechanism and prevents the sear module 736 from disengaging with the striker mechanism during a drop or rough handling. Stated differently, beneficially the examples described here prevent accidental misfires in firearms with modular fire control units 704.

In certain examples, the sear springs 742 can be a single spring or two or more springs. The sear springs 742 are configured to bias the sear module 736 into engagement with a striker (not shown). The disconnector 740 is urged downward by the slide (not shown) and in turn disengages the sear activation module 720 from the sear module 736 to allow the sear module 736 to return to its upward or default position of being in contact with the striker.

Referring again to the sear activation module 720, extending outward laterally is an interface surface 746 configured to engage with a corresponding surface of the takedown bar 724. In certain examples, the interface surface is vertically oriented and angled with respect to a direction of movement 748 of the trigger 702. Stated differently, a plane defined by the interface surface 746, in certain examples is transverse to an axis defined by the direction of travel 748 of the trigger 702 and disposed at an angle with respect to that axis. Movement of this vertically oriented and angled interface surface 746 with respect to a corresponding surface of the takedown bar 724, causes lateral movement of the sear activation module 720 within the fire control unit 704. A notch 750 in a downwardly extending arm of the sear housing 734 is configured to receive the interface surface 746 (see FIGS. 8A and 8B).

Figure 8A:
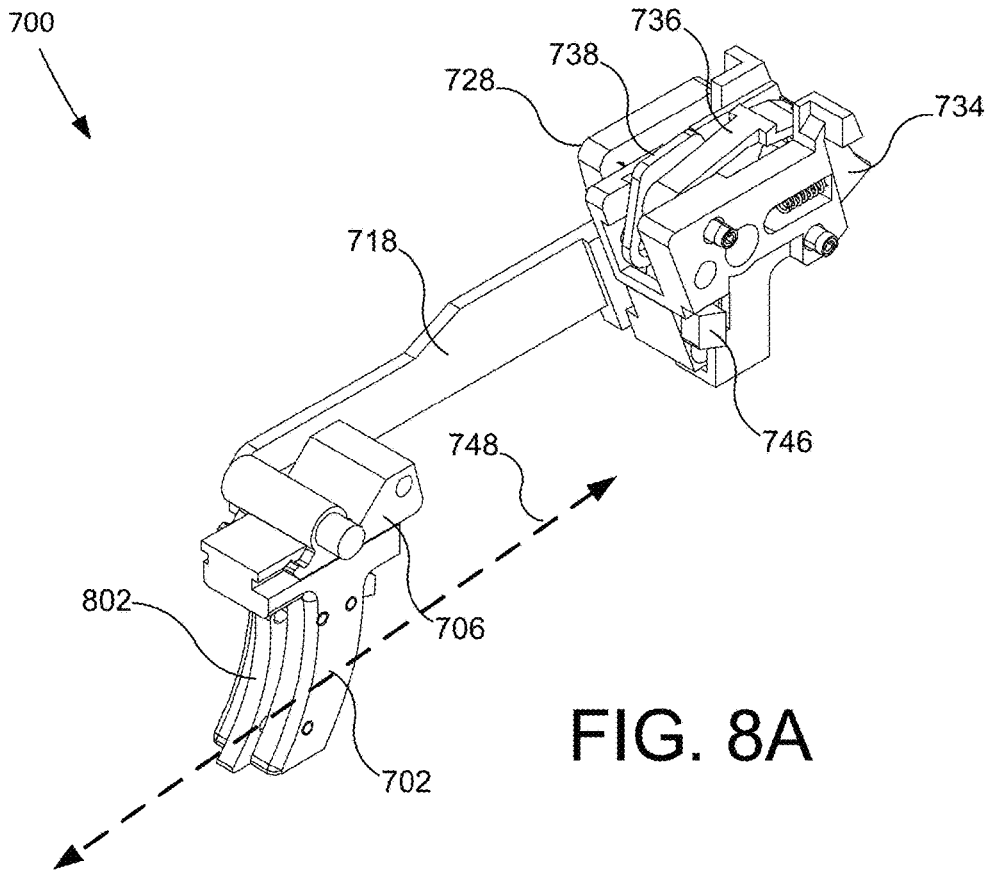
FIGS. 8A and 8B are diagrams illustrating examples of the trigger mechanism according to examples of the subject disclosure.
Figure 8B:
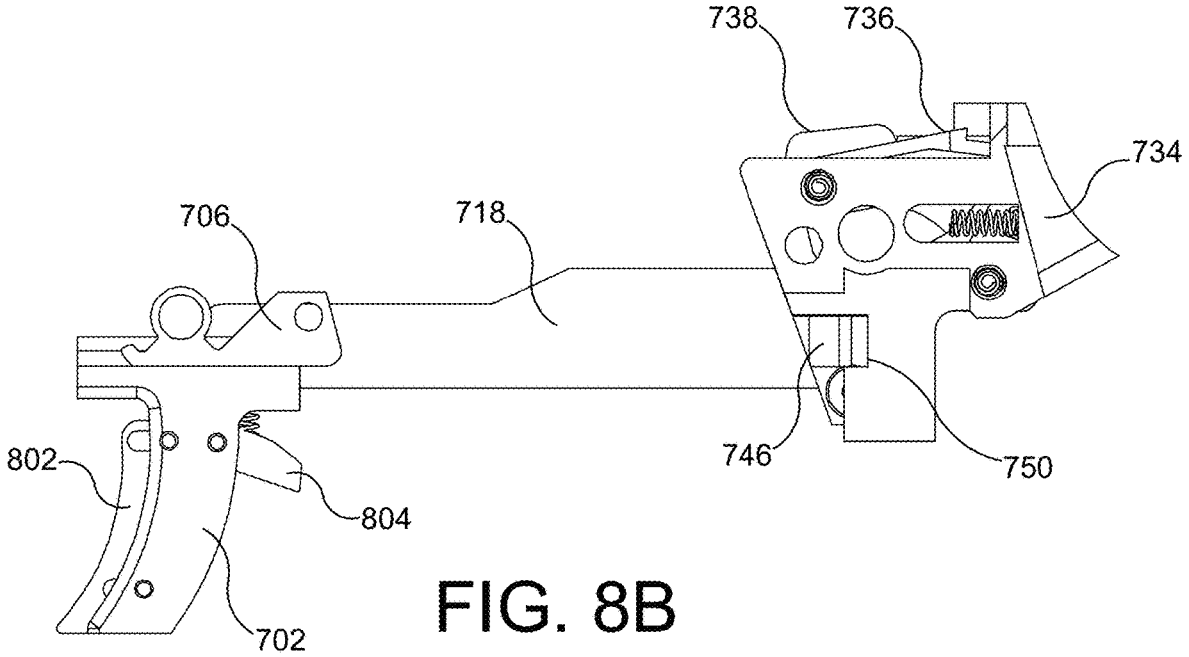

FIGS. 8A and 8B are diagrams illustrating examples of the trigger mechanism 700 according to examples of the subject disclosure. The trigger mechanism 700, in the depicted perspective and side view diagrams, respectively, are shown in an assembled configuration outside of the fire control unit 704. As with the trigger 202 described above with respect to FIGS. 2-6, the trigger 702 is configured to interface with a linearly slidable trigger safety 802. The trigger safety 802 is movable along a linear axis with respect to the trigger 702. For example, the trigger safety 802 may be disposed within a channel formed in the center of the trigger 702. Openings formed in the trigger safety 802 define a linear pathway of movement for the trigger safety 802 with respect to the trigger 702.

The trigger mechanism 700 also includes a blocking lever 804. The blocking lever 804 may be biased towards a blocking position by a compression spring, or other biasing means. The blocking lever 804 functions in a manner similar to that described above with reference to the blocking lever 208 of FIGS. 2-6. The blocking lever 804 is configured to rotate about a pivot pin from a blocking position that prevents movement of the trigger 702 to a position (the "second position") that allows the trigger 702 to move linearly along the direction 748 with reference to the frame or body of the firearm.

If the blocking lever 804 is in the second position, the linear movement of the trigger 702 translates to movement of the trigger bar 718. As the trigger bar 718 moves rearward it actuates the sear module 736 to disengage the sear module 736 from the striker. When a user releases the trigger 702, the trigger bar return spring (see FIG. 7) returns the trigger bar 718 and the trigger 702 to the default position.

Figure 9A:
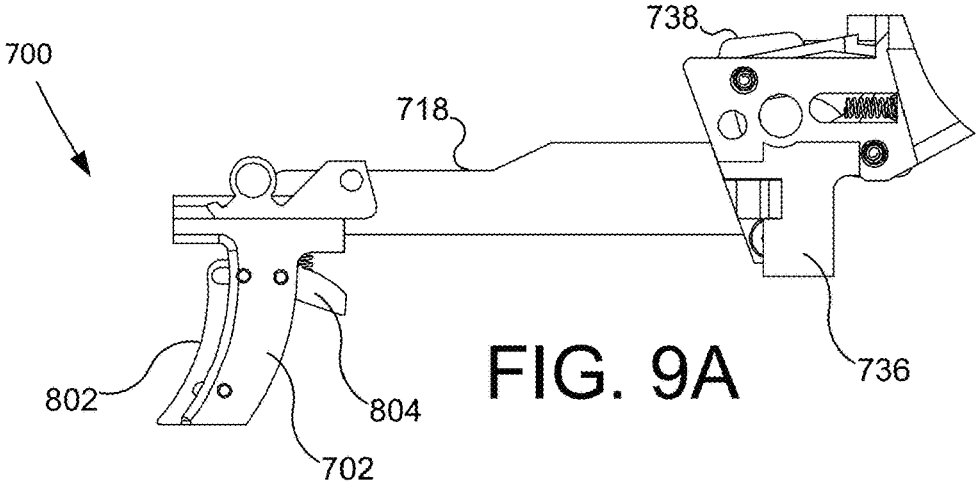
FIGS. 9A, 9B, and 9C are side view diagrams illustrating different positions of the trigger mechanism, in accordance with examples of the subject disclosure.
Figure 9B:
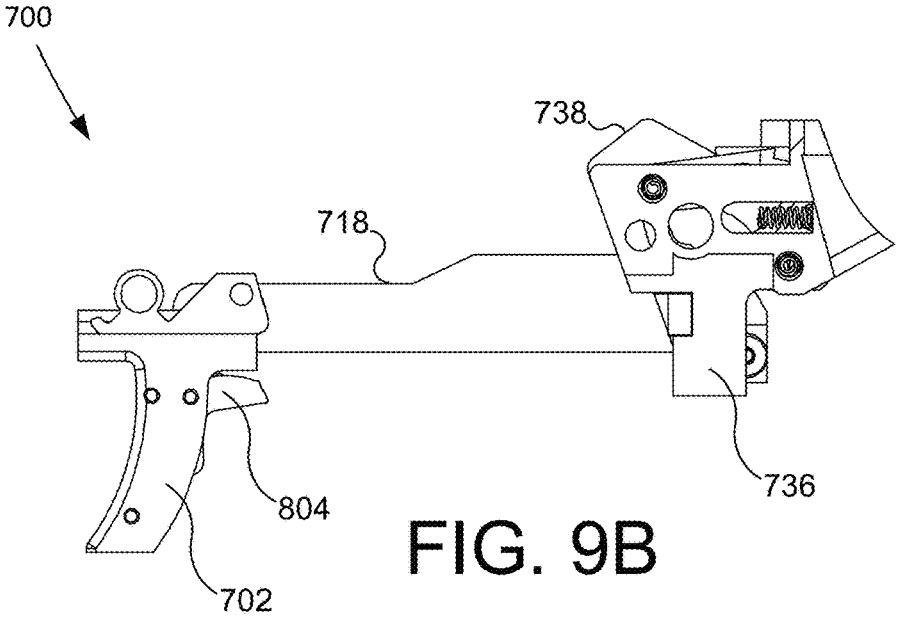
Figure 9C:
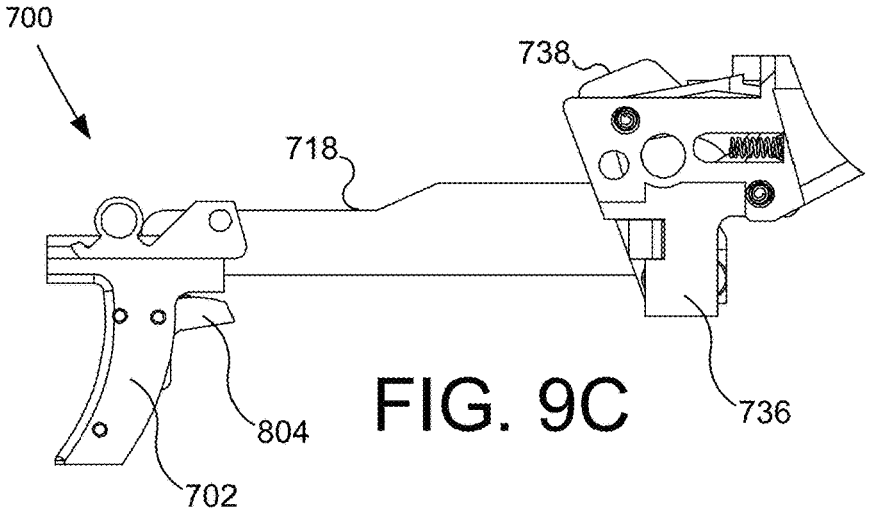

FIGS. 9A, 9B, and 9C are side view diagrams illustrating different positions of the trigger mechanism 700, in accordance with examples of the subject disclosure. In particular, FIG. 9A depicts a default, or at rest, position of the trigger mechanism 700. In this default position, the trigger safety 802 is offset and in front of the trigger 702. The spring of the blocking lever 804 rotates the blocking lever 804 downward which subsequently urges the trigger safety 802 forward, with reference to the trigger 702.

FIG. 9B illustrates a "trigger pulled" position but before the trigger bar 718 engages the sear module. When a user begins to pull on the trigger 702, the trigger safety 802 first collapses into the trigger 702 and rotates the blocking lever 804 into the second position to allow the trigger 702 to move linearly rearward with respect to the pistol. The trigger bar 718 moves in unison with the trigger 702 and activates the sear module 736. Also visible in this diagram is that the striker block safety deactivation lever 738 has rotated forward as compared to its position in FIG. 9A. FIG. 9C illustrates a "trigger takeup" position. Trigger takeup refers to the initial movement of the trigger 702 prior to resistance being felt by the engagement of the trigger bar 718 with the sear module 736.

FIGS. 10A, 10B, 10C, and 10D are side view diagrams illustrating various positions of the trigger mechanism 700 in accordance with examples of the subject disclosure. The diagrams illustrate partial views of the trigger mechanism 700 to give clarity to the interaction of the various components. FIGS. 9A-9C depicted the left side of the trigger mechanism 700 and FIGS. 10A-10D depict the right side of the trigger mechanism 700.

Figure 10A:
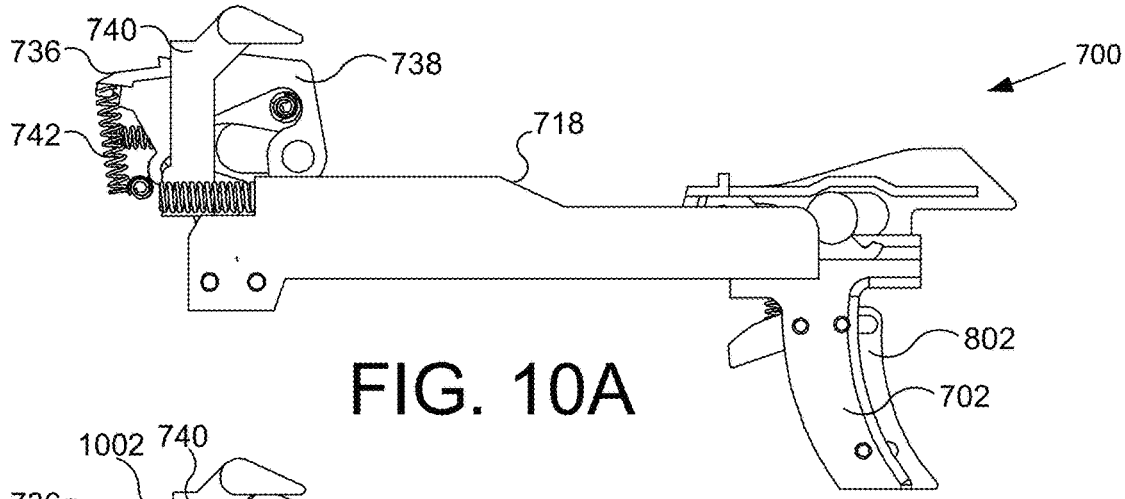
FIGS. 10A, 10B, 10C, and 10D are side view diagrams illustrating various positions of the trigger mechanism in accordance with examples of the subject disclosure.

Referring now to FIG. 10A, depicted here is a default position of the trigger mechanism. The trigger safety 802 extends forward from the trigger 702 when a user is not applying a force to the trigger 702. The blocking lever 804 is in its default or blocking position where an end of the blocking lever 804 is making contact with a frame of the firearm.

Figure 10B:
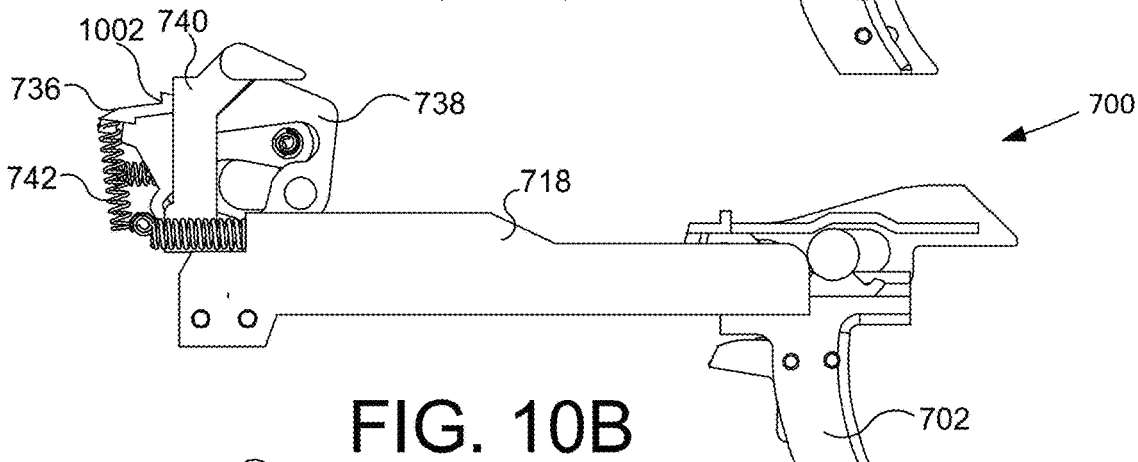

FIG. 10B depicts the trigger takeup transition, or in other words, the movement of the trigger 702 and trigger bar 718 prior to encountering resistance from the sear module 736. The entire sear module 736 is not viewable here, however the striker engagement surface 1002 is depicted. The striker engagement surface 1002, in certain examples, is a lip or edge that captures the striker (not shown). As the trigger bar 718 moves rearward, it pulls the sear module 736 downward. This eventually disengages the striker engagement surface 1002 (see FIG. 10C) from the striker and allows the striker to fire the firearm. Seer springs 742 bias the pivoting sear module 736 upward, or in reference to this diagram, in a clockwise direction.

Figure 10C:
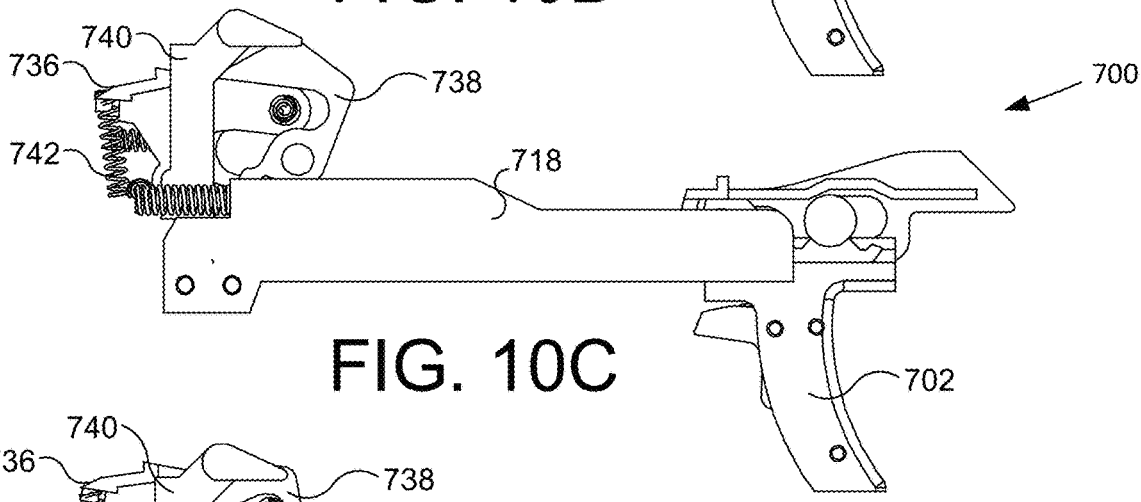

FIG. 10C is a side view diagram illustrating one example of the trigger mechanism 700 in a "trigger pulled" position, in accordance with examples of the subject disclosure. In the trigger pulled position, the user's finger is still depressing the trigger 702 and the trigger safety 802, which is not visible in this illustration because it is disposed within the trigger 702. The striker block safety deactivation lever 738 is rotated forward by the rearward movement of the trigger bar 718. In certain examples, the trigger bar 718 activates and applies a rearward force on the sear activation module 720. The sear activation module 720 has a protrusion that extends upward and engages with a bottom arm of the striker block safety deactivation lever 738 (not shown here). The rearward movement of the protrusion causes the striker block safety deactivation lever 738 to rotate about a pivot point forward, or in reference to this illustration, in a clockwise direction.

Figure 10D:
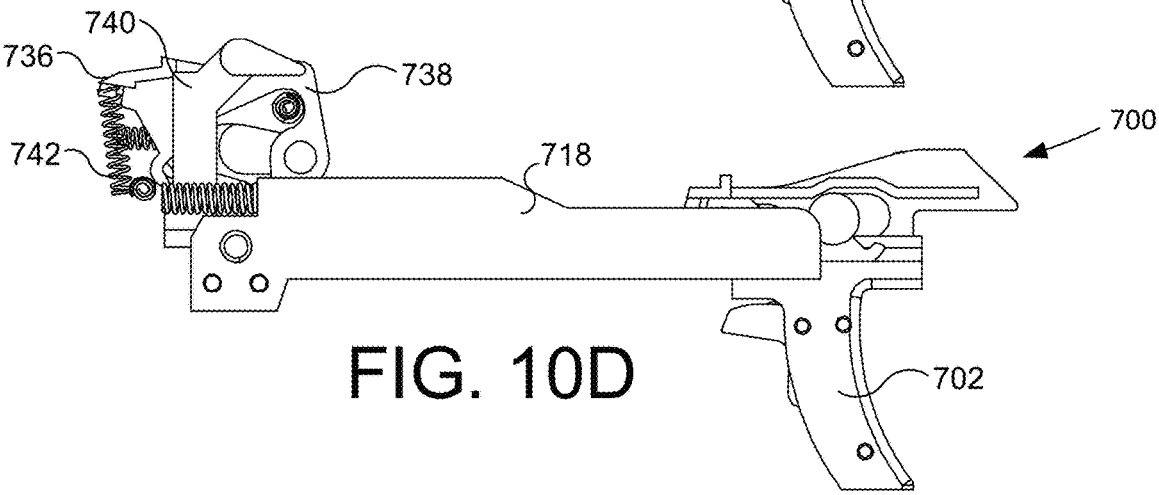

FIG. 10D is a side view diagram illustrating one example of the trigger mechanism 700 in a "disconnect" position in accordance with examples of the subject disclosure. In the disconnect position, the slide (not shown) of the firearm has traveled rearward as a result of firing a round and pushes downward on the disconnector 740. The disconnector 740 has a ramp surface (see FIG. 12) that causes a lateral movement of the sear activation module 720 that disengages the sear activation module 720 from the sear module 736, which in turn allows the sear module 736 to return to its upward position and engage the striker.

Figure 11A:
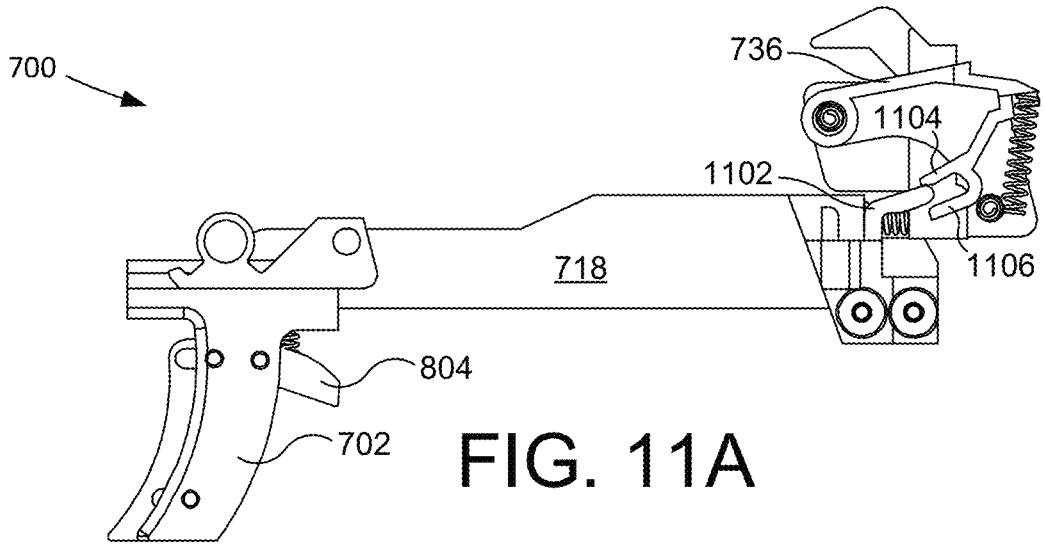
FIGS. 11A-11C are side view diagrams of the left side of the trigger mechanism in accordance with examples of the subject disclosure.
Figure 11B:
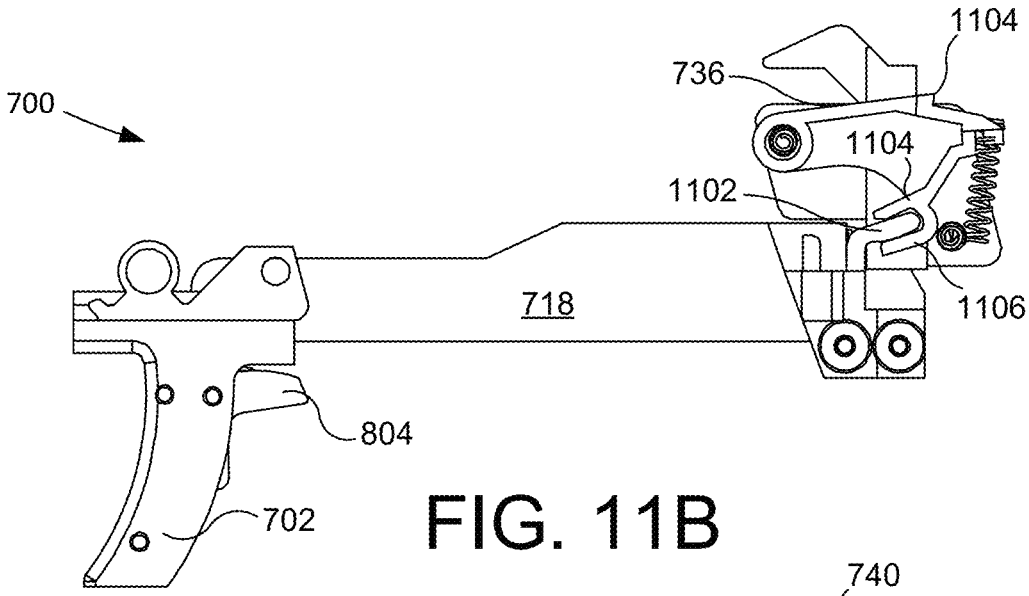
Figure 11C:
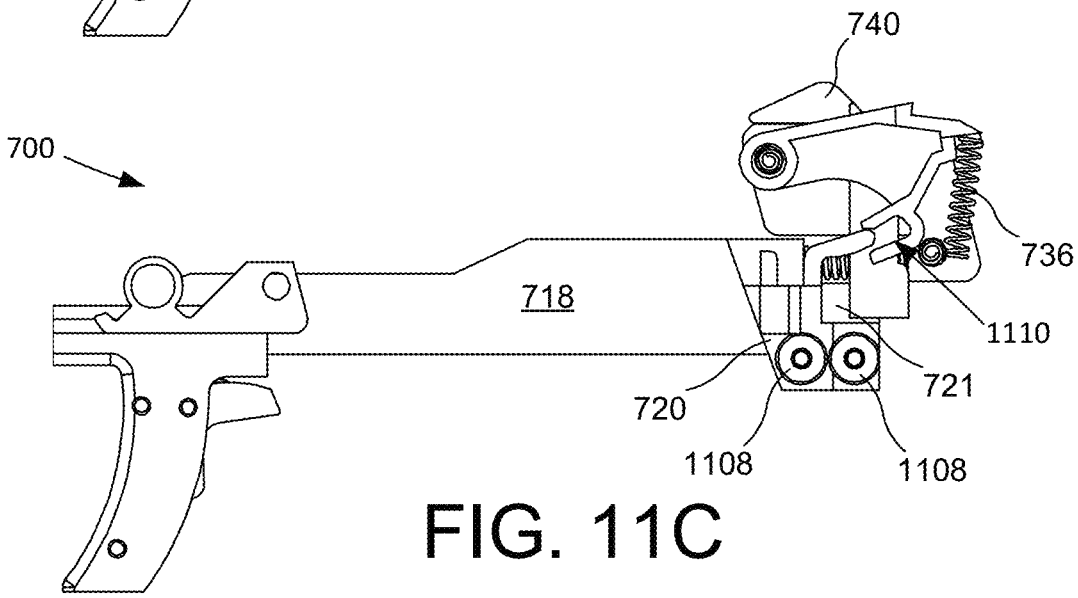

FIGS. 11A-11C are side view diagrams of the left side of the trigger mechanism 700 in accordance with examples of the subject disclosure. In particular, these diagrams illustrate how upper and lower legs of the sear module 736 interact with the sear activation module 720. In certain examples, the sear activation module 720 includes an arm 1102 that extends upward and rearward from the sear activation module 720. The arm 1102 is engaged by an upper leg 1104 and a lower leg 1106 of the sear module 736. The upper leg 1104 together with the lower leg 1106 form a pocket that receives the arm 1102 and forces full engagement of the sear module 736 to prevent accidental misfires. Stated differently, the pocket formed by the upper leg 1104 and the lower leg 1106 interfaces with the arm 1102 to apply a downward force that rotates the sear module 736 out of engagement with the striker.

The sear module 736 is configured to rotate about a pivot point. The pivot point may be a pin that is fixed positionally by the fire control unit 704. In certain examples, the sear module 736 has a pivot point disposed at one end that is opposite of an end that contains the upper leg 1104 and the lower leg 1106. The sear module 736 pivots about one of its ends that is opposite both the upper leg 1104 and the lower leg 1106.

Referring now to FIG. 11A, this diagram illustrates a default position of the trigger 702 prior to being depressed by a user. As depicted, an upper surface of the arm 1102 makes contact with the upper leg 1104 and prevents rotation of the sear module 736. Without the application of a linear pulling force by the user, the sear module 736 remains fully engaged with the striker and accidental firing is impossible. In other words, even in an accidental drop (or any other type of mishandling of the firearm), the blocking lever 804 prevents any movement of the arm 1102 which prevents any movement of the sear module 736.

FIG. 11B depicts a trigger-pulled position of the trigger mechanism 700. In this example, the user has applied a linear pulling force on the trigger 702 and has depressed the trigger safety to rotate the blocking lever 804 into a position that allows rearward movement of the trigger bar 718. As the trigger bar 718 moves rearward, the arm 1102 enters the pocket formed by the upper leg 1104 and the lower leg 1106 and subsequently applies a downward force on the lower leg 1106. This downward force causes the sear module 736 to rotate. In this diagram, the rotation is in a clockwise direction. The end result of this rotation is the disengagement of the striker engagement surface 1002 of the sear module 736 with the striker which then fires the firearm.

FIG. 11C depicts the trigger mechanism 700 in a disconnect position, in accordance with examples of the subject disclosure. After firing the firearm, the slide of the firearm cycles and depresses the disconnector 740. FIG. 11C depicts the 740 in an actuated position as compared to FIGS. 11A and 11B. The disconnector 740, in certain examples, is formed having a ramp that slidingly engages the ramp surface 721 of the sear activation module 720 and causes lateral movement of the sear activation module 720 on pins 1108 with reference to the fire control unit 704. In the depicted diagram, lateral movement of the sear activation module 720 refers to movement into or out of the page. Lateral movement of the sear activation module 720 causes the arm 1102 to move out of engagement with the pocket 1110 formed by the upper leg 1104 and the lower leg 1106. Without the arm 1102 engaging the pocket 1110 and preventing rotation, the sear spring 742 urges counter-clockwise rotation (as depicted) of the sear module 736 back into a position that fully engages the striker. The trigger mechanism 700 then returns to the default position depicted in FIG. 11A.

Figure 12:
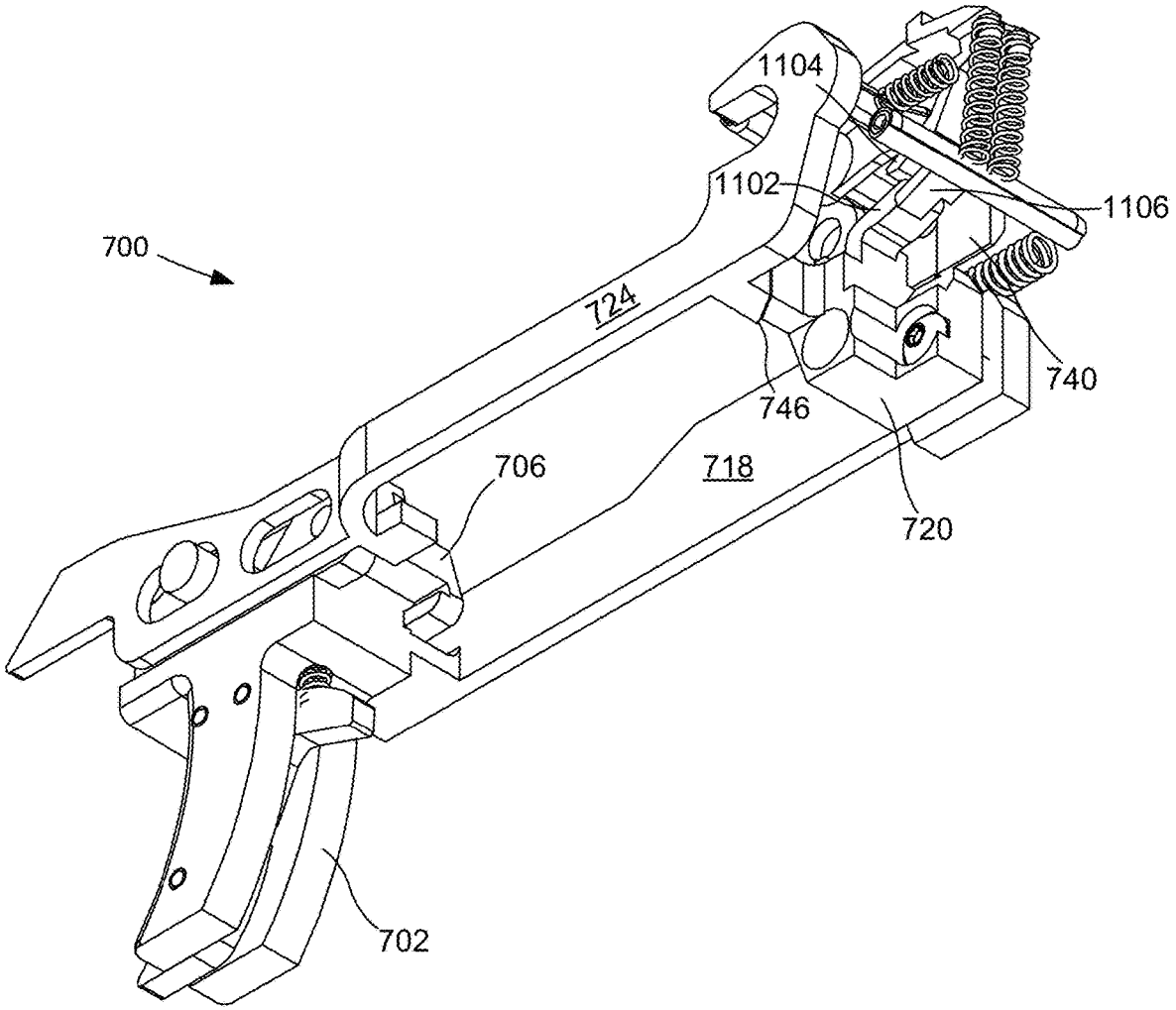
FIG. 12 is a perspective view diagram of the trigger mechanism according to examples of the subject disclosure.

FIG. 12 is a perspective view diagram of the trigger mechanism 700 according to examples of the subject disclosure. The depicted examples shows the takedown bar 724, the trigger bar 718, and the sear activation module 720. The takedown bar 724 includes the engagement surface 746 that is angled with respect to a longitudinal axis that is defined by the fire control unit 704. The sear activation module 720 includes a corresponding angled surface so that when the takedown bar 724 is actuated, the engagement surface 746 causes lateral movement of the sear activation module 720 towards a side of the fire control unit 704 that is opposite the takedown bar 724.

In certain examples, the sear activation module 720 moves longitudinally with the trigger bar 718. The sear activation module 720 is also configured to move laterally as a result of engagement with either the takedown bar 724 or the disconnector 740.

In the above description, certain terms may be used such as "up," "down," "upper," "lower," "horizontal," "vertical," "left," "right," "over," "under" and the like. These terms are used, where applicable, to provide some clarity of description when dealing with relative relationships. These terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent to another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A trigger mechanism for a firearm, comprising:

a trigger housing configured to couple with a fire control unit of the firearm;

a trigger slideably coupled with the trigger housing and movable along a linear path; and a trigger bar having a first end coupled with the trigger and a second end coupled with a sear activation module, where the sear activation module is moveable with respect to the fire control unit along a longitudinal path with the trigger bar, and where the sear activation module is moveable laterally with respect to the trigger bar.

2. The trigger mechanism of claim 1, further comprising a trigger safety slideably coupled with the trigger and moveable between a first position and a second position with reference to the trigger.

3. The trigger mechanism of claim 2, further comprising a blocking lever pivotally coupled with the trigger and moveable between a blocking position that prevents linear movement of the trigger and an allow position that allows linear movement of the trigger.

4. The trigger mechanism of claim 3, where the trigger safety is configured to actuate the blocking lever and move the blocking lever from the blocking position to the allow position when the trigger safety is moved to the second position.

5. The trigger mechanism of claim 4, further comprising a compression spring configured to bias the blocking lever to blocking position.

6. The trigger mechanism of claim 1, where the sear activation module comprises an arm for one of preventing rotation of a sear module or rotating the sear module to a position that disengages the sear module from a striker.

7. The trigger mechanism of claim 6, where the sear module further comprising a pocket for receiving the arm of the sear activation module, and where the pocket is defined by an upper leg and a lower leg.

8. The trigger mechanism of claim 7, where the pocket is disposed at one end of the sear module and a pivot point is disposed at an opposite end of the sear module.

9. The trigger mechanism of claim 1, where the trigger housing comprises a slotted channel configured to define a path of travel of the trigger.

10. The trigger mechanism of claim 9, where the trigger comprises a slotted tab configured to engage the slotted channel.

11. The trigger mechanism of claim 9, where the path of travel is linear and substantially parallel with a bore axis of the firearm.

12. A firearm having a linearly moveable trigger with respect to the firearm, the firearm comprising:

a frame;

a barrel disposed in a slide, where the slide is slideably coupled with the frame;

a trigger housing configured to couple with a fire control unit of the firearm;

a trigger slideably coupled with the trigger housing and movable along a linear path; and a trigger bar having a first end coupled with the trigger and a second end coupled with a sear activation module, where the sear activation module is moveable with respect to the fire control unit along a longitudinal path with the trigger bar, and where the sear activation module is moveable laterally with respect to the trigger bar.

13. The firearm of claim 12, further comprising a trigger safety slideably coupled with the trigger and moveable between a first position and a second position with reference to the trigger.

14. The firearm of claim 13, further comprising a blocking lever pivotally coupled with the trigger and moveable between a blocking position that prevents linear movement of the trigger and an allow position that allows linear movement of the trigger.

15. The firearm of claim 14, where the trigger safety is configured to actuate the blocking lever and move the blocking lever from the blocking position to the allow position when the trigger safety is moved to the second position.

16. The firearm of claim 15, further comprising a compression spring configured to bias the blocking lever to blocking position.

17. The firearm of claim 12, where the sear activation module comprises an arm for one of preventing rotation of a sear module or rotating the sear module to a position that disengages the sear module from a striker.

18. The firearm of claim 17, where the sear module further comprising a pocket for receiving the arm of the sear activation module, and where the pocket is defined by an upper leg and a lower leg.

19. The firearm of claim 12, where the trigger housing comprises a slotted channel configured to define a path of travel of the trigger.

20. The firearm of claim 19, where the trigger comprises a slotted tab configured to engage the slotted channel.

* * * * *